US010898987B2

(12) United States Patent
Toyomura et al.

(10) Patent No.: US 10,898,987 B2
(45) Date of Patent: Jan. 26, 2021

(54) TABLE FOR HOLDING WORKPIECE AND PROCESSING APPARATUS WITH THE TABLE

(71) Applicant: EBARA CORPORATION, Tokyo (JP)

(72) Inventors: Naoki Toyomura, Tokyo (JP); Mitsuru Miyazaki, Tokyo (JP); Junji Kunisawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 589 days.

(21) Appl. No.: 15/167,464

(22) Filed: May 27, 2016

(65) Prior Publication Data

US 2016/0346902 A1 Dec. 1, 2016

(30) Foreign Application Priority Data

Jun. 1, 2015 (JP) ..... 2015-111686
May 12, 2016 (JP) ..... 2016-096276

(51) Int. Cl.
*B24B 57/02* (2006.01)
*B24B 37/04* (2012.01)
*H01L 21/306* (2006.01)

(52) U.S. Cl.
CPC ..... *B24B 57/02* (2013.01); *B24B 37/04* (2013.01)

(58) Field of Classification Search
None
See application file for complete search history.

(56) References Cited

U.S. PATENT DOCUMENTS 5,757,789 A * 5/1998 Dent ..... H04B 7/18532 370/337
5,797,789 A 8/1998 Tanaka et al.
6,206,768 B1 3/2001 Quek
6,443,821 B1 * 9/2002 Kimura ..... B24B 37/30 348/231.6
7,108,592 B2 * 9/2006 Fukaya ..... B24B 37/30 257/E21.23

(Continued)

FOREIGN PATENT DOCUMENTS

JP H08-071511 A 3/1996
JP H09-262756 A 10/1997

(Continued)

OTHER PUBLICATIONS

Claims of Machine Generated English Translation of JP2000-127025. Published May 9, 2000 (Year: 2000).*

(Continued)

*Primary Examiner* — Sylvia MacArthur
(74) *Attorney, Agent, or Firm* — BakerHostetler

(57) ABSTRACT

Provided is a wet substrate processing apparatus for processing a substrate. The apparatus comprises a table for holding a substrate, and a process liquid feeding mechanism for feeding process liquid to the substrate held on the table. The table includes a support face for supporting the substrate, a first opening formed in the support face, a second opening formed in the support face and arranged at least partially around the first opening, a first fluid path configured to extend to the first opening of the support face via the table and be connectable to a vacuum source, and a second fluid path configured to extend to the second opening of the support face via the table and discharge the process liquid.

21 Claims, 5 Drawing Sheets

(56) References Cited

U.S. PATENT DOCUMENTS

| | | | | |
|---|---|---|---|---|
| 2003/0027506 | A1* | 2/2003 | Herb | B24B 37/16 451/60 |
| 2004/0048553 | A1* | 3/2004 | Lee | B24B 37/30 451/41 |
| 2005/0107016 | A1* | 5/2005 | Hoshino | B24B 37/04 451/287 |
| 2014/0120725 | A1* | 5/2014 | Miyazaki | H01L 21/67051 438/692 |
| 2016/0346902 | A1* | 12/2016 | Toyomura | B24B 57/02 |

FOREIGN PATENT DOCUMENTS

| | | | |
|---|---|---|---|
| JP | 2000-127025 | A | 5/2000 |
| JP | 2001-044151 | A | 2/2001 |
| JP | 2009-260120 | A | 11/2009 |

OTHER PUBLICATIONS

Specification of Machine Generated English Translation of JP2000-127025. Published May 9, 2000 (Year: 2000).*

Machine Generated English Translation of the description of JP 2009260120. Published Nov. 5, 2009 (Year: 2009).*

Machine Generated English Translation of the claims of JP 2009260120 Published Nov. 5, 2009 (Year: 2009).*

* cited by examiner

TABLE FOR HOLDING WORKPIECE AND PROCESSING APPARATUS WITH THE TABLE

CROSS-REFERENCE TO RELATED APPLICATION

This application is based upon and claims the benefit of priority of the prior Japanese Patent Application No. 2015-111686, filed on Jun. 1, 2015, and Japanese Patent Application No. 2016-96276, filed on May 12, 2016, the entire contents of which are incorporated herein by reference.

TECHNICAL FIELD

The present invention relates to a table for holding a workpiece, such as a semiconductor substrate, and a processing apparatus with the table.

BACKGROUND

In the field of the manufacture of semiconductor devices, CMP (Chemical Mechanical Polishing) apparatuses for polishing substrate surfaces are known. A CMP apparatus has a polishing face which is formed by attaching a polishing pad to the upper face of a polishing table. The CMP apparatus presses the to-be-polished face of a substrate held by a top ring against the polishing face, and rotates the polishing table and the top ring while feeding the polishing face with slurry which functions as polishing liquid. This makes the polishing face and the to-be-polished face slide against each other, resulting in the to-be-polished face being polished.

In typical CMP apparatuses, a polishing table or pad is larger than a substrate to be polished. The substrate is polished with the to-be-polished face held downward by the top ring. The substrate, after being polished, is cleansed and dried. The cleansing is performed by rotating a sponge made of polyvinyl alcohol (PVA) or the like while maintaining the sponge in contact with the substrate.

According to known finishing units, a contact member with a smaller diameter than a substrate is pressed against a polished substrate, and the substrate and the contact member are then brought into relative movement (see Patent Document 1, for example). Such a finishing unit is installed in a CMP apparatus separately from a polishing section which is a main part. The finishing unit gives a slight additional polishing to a substrate and cleanses the substrate after the substrate undergoes primary polishing.

Patent Document 1: Japanese Unexamined Patent Application Publication (Kokai) No. H08-71511

SUMMARY

With regard to an apparatus for polishing a substrate, to enhance a cleansing effect by bringing a contact member into contact with the substrate at high pressure or increase the polishing speed, the substrate is preferably held on a table configured to come into contact with the entire back surface of a substrate when supporting the substrate. One example of such a table is a table having small apertures for vacuum-sucking a substrate. The table which vacuum-sucks the substrate has the possibility that negative pressure is generated in a gap between the support face of the table supporting the substrate and the substrate, and therefore that the slurry or another process liquid used to polish the substrate is sucked through the gap between an edge of the substrate and the table to reach the inside of the small apertures. There is another possibility that, when gas or liquid is jetted from the small apertures for the purpose of releasing the substrate from the support face of the table, the sucked slurry or another process liquid flows out from the gap between the support face of the table and the substrate, and runs around to the upper face of the substrate to smudge the substrate.

In view of these possibilities, it is desirable that the slurry or another process liquid be prevented, as much as possible, from being sucked into the small apertures of the table for vacuum-sucking the substrate. It is also desirable that, at the time of releasing the substrate from the table, the sucked slurry or another process liquid be prevented as much as possible from flowing around onto the substrate.

An object of the present invention is to solve or alleviate at least part of the problems noted above.

A first embodiment of the invention provides a wet substrate processing apparatus for processing a substrate. The wet substrate processing apparatus includes a table for holding a substrate, and a process liquid feeding mechanism for feeding process liquid to the substrate held on the table. The table includes a support face for supporting the substrate, a first opening formed in the support face, a second opening formed in the support face and arranged at least partially around the first opening, a first fluid path configured to extend to the first opening of the support face through the table and be connectable to a vacuum source, and a second fluid path configured to extend to the second opening of the support face through the table and open the second opening to the atmosphere.

In a second embodiment of the invention according to the first embodiment, the second fluid path extends through at least part of the table.

In a third embodiment of the invention according to the second embodiment, the table includes an expanded edge portion which extends in such a direction that a surface of the table expands; the second opening is located in the expanded edge portion; and the second fluid path extends through the expanded edge portion.

In a fourth embodiment of the invention according to any one of the first to third embodiments, the first fluid path is configured to be connectable to a fluid feeding source for feeding fluid from the first opening through the first fluid path.

In a fifth embodiment of the invention according to the fourth embodiment, the fluid includes at least one from a group consisting of air, nitrogen, and water.

In a sixth embodiment of the invention according to any one of the first to fifth embodiments, the table is configured to be rotatable.

In a seventh embodiment of the invention according to any one of the first to sixth embodiments, there is provided a polishing pad for polishing the substrate.

An eighth embodiment of the invention provides a wet substrate processing apparatus for processing a substrate. The wet substrate processing apparatus includes a table for holding a substrate, and a process liquid feeding mechanism for feeding process liquid to the substrate held on the table. The table includes a support face for supporting the substrate, a first opening formed in the support face, a second opening formed in the support face and arranged at least partially around the first opening, a first fluid path configured to extend to the first opening of the support face through the table and be connectable to a vacuum source, and a second fluid path configured to extend to the second opening of the support face through the table and be connectable to a fluid feeding source.

In a ninth embodiment of the invention according to the eighth embodiment, the fluid includes at least one from a group consisting of air, nitrogen, and water.

In a tenth embodiment of the invention according to any one of the first to ninth embodiments, the table is configured to be rotatable.

In an eleventh embodiment of the invention according to any one of the eighth to tenth embodiments, there is provided a polishing pad for polishing the substrate.

A twelfth embodiment of the invention provides a wet substrate processing apparatus for processing a substrate. The wet substrate processing apparatus includes a table for holding a substrate, and a process liquid feeding mechanism for feeding process liquid to the substrate held on the table. The table includes a support face for supporting the substrate, a first opening formed in the support face, a second opening formed in the support face and arranged at least partially around the first opening, a first fluid path configured to extend to the first opening of the support face through the table and be connectable to a fluid feeding source, and a second fluid path configured to extend to the second opening of the support face through the table and be connectable to a vacuum source.

In a thirteenth embodiment of the invention according to the twelfth embodiment, the fluid includes at least one from a group consisting of air, nitrogen, and water.

In a fourteenth embodiment of the invention according to the twelfth or thirteenth embodiment, the first fluid path is configured to be connectable to the vacuum source.

In a fifteenth embodiment of the invention according to any one of the twelfth to fourteenth embodiments, the table is configured to be rotatable.

In a sixteenth embodiment of the invention according to any one of the twelfth to fifteenth embodiments, there is provided a polishing pad for polishing the substrate.

A seventeenth embodiment of the invention provides a backing member is configured to be mountable on a table for holding a substrate. The backing member includes through-holes in positions which coincide with the first and second openings of the table of the wet substrate processing apparatus according to any one of the first to sixteenth embodiments when the backing member is mounted on the table.

DETAILED DESCRIPTION

Figure 1:
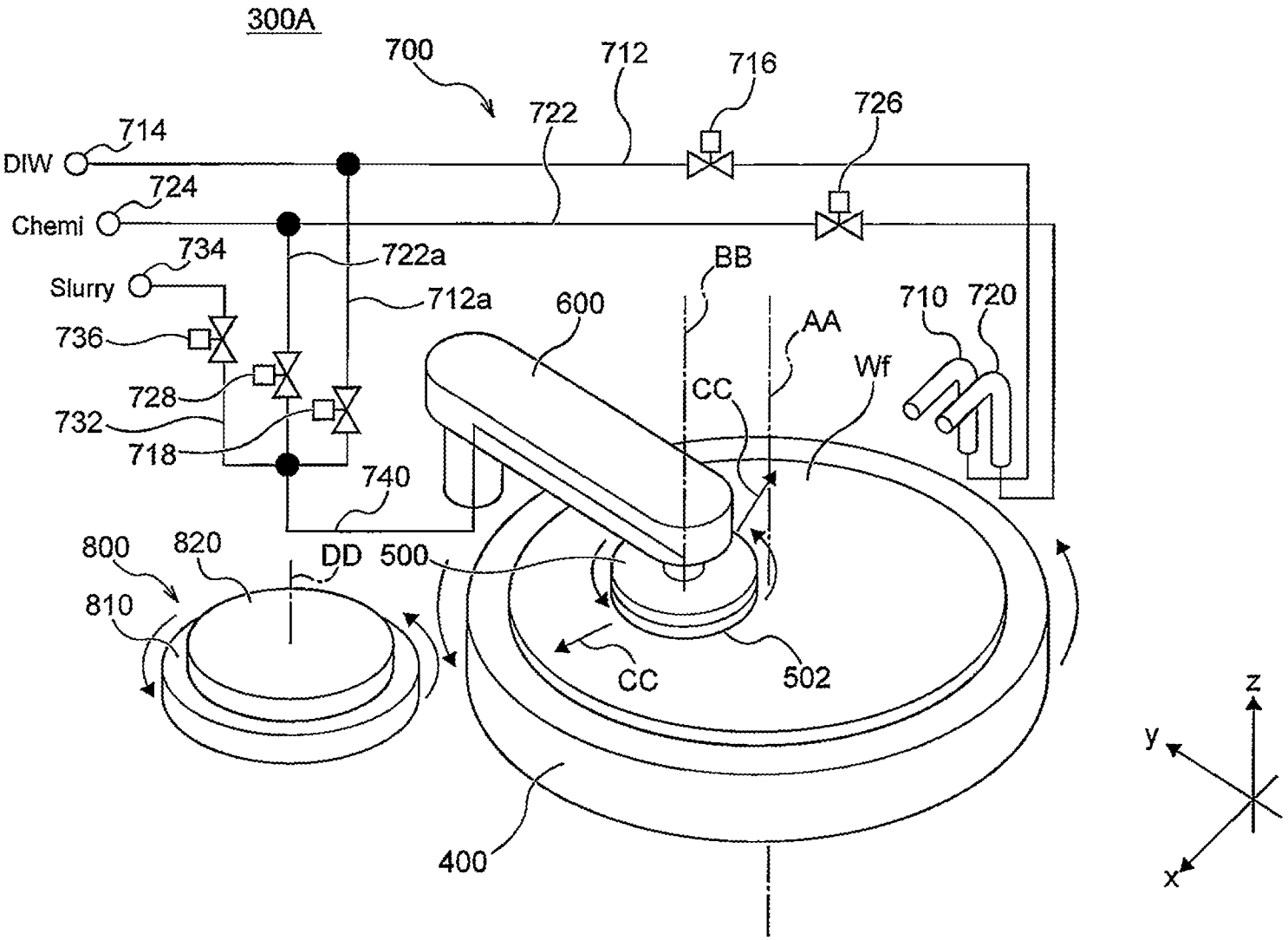
FIG. 1 shows a schematic configuration of a buffing apparatus as an example of a processing apparatus having a table for processing a workpiece.

The following description explains embodiments of a table for holding a workpiece and a processing apparatus having the table according to the invention with reference to the attached drawings. In the drawings, identical or similar elements are provided with identical or similar reference marks. In the description of the embodiments, if the descriptions of the identical or similar elements overlap, such overlapped descriptions may be omitted. Features illustrated in each embodiment are applicable to the other embodiments unless otherwise contradicted.

FIG. 1 shows a schematic configuration of a buffing apparatus as an example of a processing apparatus having a table for processing a workpiece. The buffing apparatus illustrated in FIG. 1 may be configured as a part of a CMP apparatus for polishing a substrate such as a semiconductor wafer or as a single unit installed in a CMP apparatus. By way of example, the buffing apparatus may be incorporated into a CMP apparatus including a polishing unit, a cleansing unit, and a substrate transfer mechanism. The buffing apparatus may be utilized for a finishing process after primary polishing in the CMP apparatus.

Buffing here refers to at least either one of buff polishing and buff cleansing.

Buff polishing is a process which polishes and removes a processed face of a substrate by bringing the substrate and a buffing pad into relative movement and applying slurry between the substrate and the buffing pad while maintaining the buffing pad in contact with the substrate. The buff polishing allows a physical acting force to act on the substrate, which is larger than a physical acting force applied to the substrate when the substrate is cleansed by physical action using a sponge (PVA sponge, for example) or the like. It is therefore possible to utilize, as a buffing pad, a pad fabricated by laminating polyurethane foam and non-woven fabric, which is more specifically an IC1000™ or SUBA® pad available on markets, or a suede-like porous polyurethane non-fibrous pad which is more specifically a POLITEX® pad also available on markets. The buff polishing removes a surface layer which is damaged with scratches or marked with stains, additionally removes a portion which cannot be removed by primary polishing performed in a main polishing unit, and improves morphology including irregularity in micro regions and film thickness distribution in the entire substrate after main polishing is conducted.

Buff cleansing is a process which removes stains on a surface of the substrate by bringing the substrate and the buffing pad into relative movement and applying cleansing liquid (chemical solution or both chemical solution and deionized water) between the substrate and the buffing pad while maintaining the buffing pad in contact with the substrate, and improves the quality of the processed face. The buff cleansing allows a physical acting force to act on the substrate, which is larger than a physical acting force applied to the substrate when the substrate is cleansed by physical action using a sponge or the like. Used as a buffing pad, in this view, is the above-mentioned IC1000™ or SUBA® pad, a POLITEX® pad or the like. It is also possible to use PVA sponge as a buffing pad in the buffing apparatus according to the invention.

FIG. 1 schematically shows a configuration of a buffing module 300A attached with a wafer Wf (substrate), according to one embodiment. As illustrated in FIG. 1, the buffing module 300A according to the one embodiment includes a buffing table 400 on which the wafer Wf is situated, a buffing head 500 attached with a buffing pad 502 for buffing a processed face of the wafer Wf, a buffing arm 600 configured to hold the buffing head 500, a liquid feeding system 700 for feeding various kinds of process liquids, and a conditioning section 800 for performing conditioning (dressing) of the buffing pad 502.

The buffing module 300A is capable of performing the above-described buff polishing and/or buff cleansing.

Although details will be given later, the buffing table 400 upwardly supports the to-be-processed face of the wafer Wf. The buffing table 400 is capable of holding the wafer Wf by vacuum suction so that the wafer Wf is on a support face 402 of the buffing table 400. The wafer Wf may be sucked onto the buffing table 400 with a backing material 450 (see FIG. 2) intervening therebetween. The backing material 450 can be made, for example, of resilient polyurethane foam. As a shock-absorbing material between the buffing table 400 and the wafer Wf, the backing material 450 prevents the wafer Wf from being scratched, and mitigates effects on buffing from irregularity of a surface of the buffing table. The backing material 450 can be attached to the surface of the buffing table 400 with adhesive tape. The backing material 450 may be a publicly known backing material. The backing material 450 may also be a backing material in which a throughhole 452 is formed in a position coinciding with an opening 404 formed in the buffing table 400 (see FIG. 2). The support face 402 of the buffing table 400 may be formed in a round shape and is thus capable of holding the wafer Wf in a round shape.

In this description, when the wafer Wf is attached to the buffing table 400 with the backing material 450 intervening therebetween, a surface of the backing material 450 attached to the buffing table 400 functions as the "support face" which supports the wafer Wf. When the wafer Wf is sucked directly onto the buffing table 400 without the backing material 450, the surface of the buffing table functions as the "support face" which supports the wafer Wf. Hereinafter, the "support face" and the "support face of the buffing table" will cover both the support faces described above.

The buffing table 400 includes a lift pin 480 (see FIG. 2) for receiving the wafer Wf transferred by a transfer robot (not shown) which functions as a transfer mechanism located on the table 400, and placing the wafer Wf of the buffing table 400. The lift pin 480 comprises a plurality of lift pins disposed along an outer periphery of the buffing table 400. The lift pins 480 are raised and lowered by mechanism (not shown). The lift pins 480 support and receive an outer peripheral portion of the wafer Wf in protruding positions. The lift pins 480 then retreat and place the wafer Wf on the support face 402 of the buffing table 400. After buffing is conducted, the lift pins 480 protrude to support and lift the outer peripheral portion of the wafer Wf. The transfer robot takes up the wafer Wf from below.

The buffing table 400 can be rotated around a rotation axis AA by a drive mechanism (not shown). The buffing head 500 can be raised and lowered. The buffing pad 502 is attached to a face of the buffing head 500, which is opposed to the wafer Wf. When the buffing head 500 is lowered, the buffing pad 502 is pressed against the wafer Wf which is held on the support face 402 of the buffing table 400. The buffing arm 600 is capable of rotating the buffing head 500 around a rotation axis BB and at the same time swinging the buffing head 500 in a radial direction of the wafer Wf as shown by arrow CC. The buffing arm 600 is capable of swinging the buffing head 500 to such a position that the buffing pad 502 faces the conditioning section 800.

The liquid feeding system 700 includes a deionized water nozzle 710 for feeding deionized water (DIW) to the processed face of the wafer Wf. The deionized water nozzle 710 is connected to a deionized water feeding source 714 through a deionized water line 712. The deionized water line 712 is provided with an on-off valve 716 which opens/closes the deionized water line 712. A control unit (not shown) is used to control the opening/closing of the on-off valve 716, feeding deionized water to the processed face of the wafer Wf or the support face 402 for supporting the wafer Wf of the buffing table 400 with any timing.

The liquid feeding system 700 further includes a first chemical solution nozzle 720 for feeding chemical solution (Chemi) to the processed face of the wafer Wf. The first chemical solution nozzle 720 is used to feed the chemical solution to a surface of the wafer Wf during buff cleansing or chemical solution cleansing which is performed after polishing. The first chemical solution nozzle 720 is connected to a first chemical solution feeding source 724 through a chemical solution line 722. The chemical solution line 722 is provided with an on-off valve 726 which opens/closes the chemical solution line 722. A control unit (not shown) is used to control the opening/closing of the on-off valve 726. The chemical solution is thus fed to the processed face of the wafer Wf or the support face 402 for supporting the wafer Wf of the buffing table 400 with any timing.

According to the buffing module 300A of the embodiment illustrated in FIG. 1, any one of deionized water, chemical solution, and slurry is selectively fed to the processed face of the wafer Wf or the support face 402 for supporting the wafer Wf of the buffing table 400 by using the buffing arm 600, the buffing head 500, and the buffing pad 502.

More specifically, a branch deionized water line 712*a* runs from the deionized water line 712 at a position between the deionized water feeding source 714 and the on-off valve 716. A branch chemical solution line 722*a* runs from the chemical solution line 722 at a position between the first chemical solution feeding source 724 and the on-off valve 726. The branch deionized water line 712*a*, the branch chemical solution line 722*a*, and a slurry line 732 connected to a slurry feeding source 734 join into a liquid feeding line 740. The branch deionized water line 712*a* is provided with an on-off valve 718 which opens/closes the branch deionized water line 712*a*. The branch chemical solution line 722*a* is provided with an on-off valve 728 which opens/closes the branch chemical solution line 722*a*. The slurry line 732 is provided with an on-off valve 736 which opens/closes the slurry line 732.

The liquid feeding line 740 has a first end which is connected to 3-line-system including the branch deionized water line 712*a*, the branch chemical solution line 722*a*, and the slurry line 732. The liquid feeding line 740 extends through the inside of the buffing arm 600, the center of the buffing head 500, and the center of the buffing pad 502. The liquid feeding line 740 further has a second end which opens toward the processed face of the wafer Wf or the support face 402 for supporting the wafer Wf of the buffing table 400. The control unit (not shown) controls the opening and closing of the on-off valves 718, 728 and 736 to feed, with any timing, any one of deionized water, chemical solution, and slurry or a mixture of any combination of deionized water, chemical solution, and slurry to the processed face of the wafer Wf or the support face 402 for supporting the wafer Wf of the buffing table 400.

The buffing module 300A of the embodiment in FIG. 1 performs the buffing of the wafer Wf by feeding the process liquid to the wafer Wf through the liquid feeding line 740, rotating the buffing table 400 around the rotation axis AA, pressing the buffing pad 502 against the processed face of the wafer Wf, and swinging the buffing head 500 in the direction of the arrow CC while rotating the buffing head 500 around the rotation axis BB. The buffing module 300A thus performs the buffing of the wafer Wf.

The conditioning section 800 illustrated in FIG. 1 is a member for conditioning a surface of the buffing pad 502. The conditioning section 800 includes a dressing table 810, and a dresser 820 situated in the dressing table 810. The dressing table 810 can be rotated around a rotation axis DD by a drive mechanism (not shown). The dresser 820 comprises a diamond dresser, a brush dresser or a combination of diamond and brush dressers.

Figure 2:
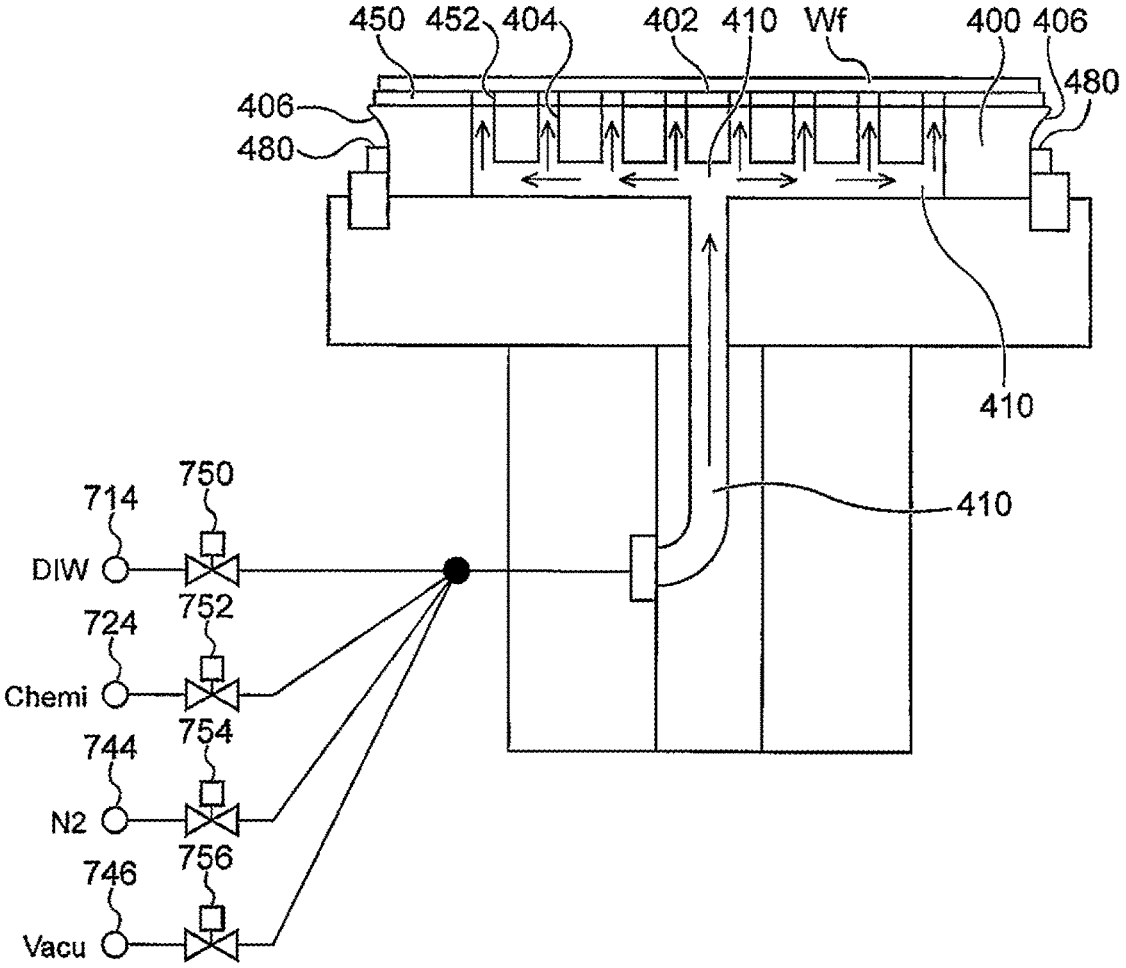
FIG. 2 schematically shows a cross-sectional view of a buffing table as one embodiment.

When conditioning the buffing pad 502, the buffing module 300A moves the buffing arm 600 to such a position that the buffing pad 502 faces the dresser 820 (see FIG. 2). While rotating the dressing table 810 around the rotation axis DD, the buffing module 300A rotates the buffing head 500 and presses the buffing pad 502 against the dresser 820, to thereby condition the buffing pad 502.

Figure 3A:
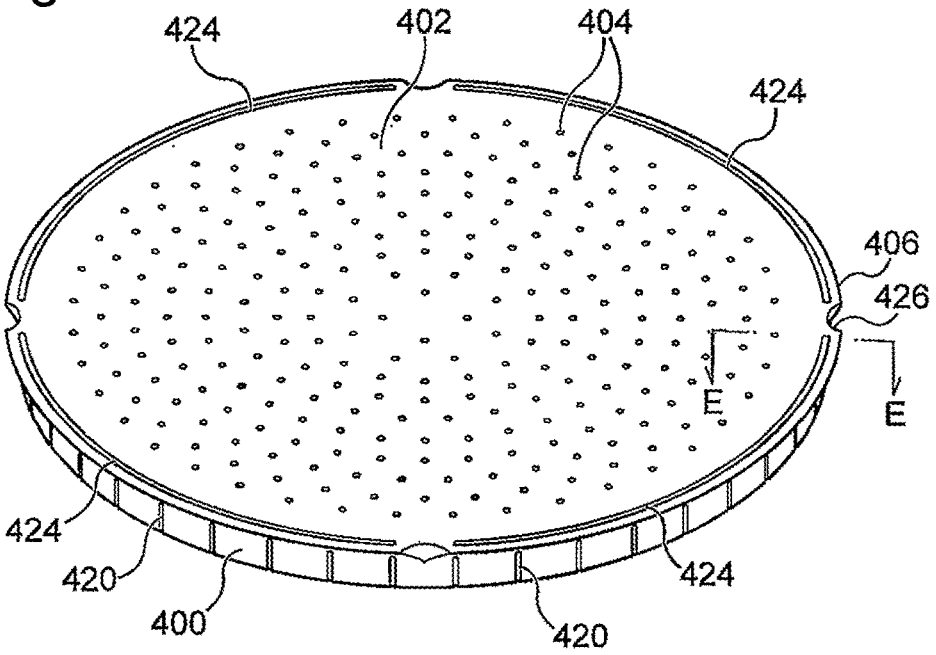
FIG. 3A is a perspective view showing an upper face of the buffing table illustrated in FIG. 2.

FIG. 2 schematically shows a cross-sectional view of the buffing table 400 as one embodiment. FIG. 2 shows the backing material 450 and the wafer Wf in a held position. FIG. 3A is a perspective view showing an upper face of the buffing table 400 illustrated in FIG. 2. The buffing table 400 includes the support face 402 for upwardly supporting the to-be-processed face of the wafer Wf. Formed in the support face 402 of the buffing table 400 are a plurality of first openings 404 for vacuum-sucking the wafer Wf onto the support face 402. The buffing table 400 is provided inside with a first fluid path 410 extending to the first openings 404. The first fluid path 410 is connected to a vacuum source 746. The first fluid path 410 is further connected to a deionized water feeding source 714 and a nitrogen source 744, which are usable at the release of the wafer Wf. The first fluid path 410 may include an atmospheric relief valve (not shown) which releases the first fluid path 410 to the atmosphere. At the time of releasing the wafer Wf, for example, the vacuum in the first fluid path 410 is released to feed the first fluid path 410 with deionized water only for a predetermined period of time, and then nitrogen only for a predetermined period of time. The buffing table 400 can be connected to a second chemical solution feeding source 724 which can be optionally used to cleanse the support face 402 of the buffing table 400 and/or the first fluid path 410. On-off valves 750, 752, 754 and 756 are respectively provided to the lines for feeding deionized water, chemical solution, and nitrogen gas to the first fluid path 410 of the buffing table 400, and the line for vacuumizing the first fluid path 410. A control unit (not shown) is used to control the opening/closing of the on-off valves 750, 752, 754 and 756, thereby feeding deionized water, chemical solution, and nitrogen gas to the support face 402 through the first fluid path 410 of the buffing table 400 with any timing or vacuumizing the first fluid path 410 with any timing.

Figure 3B:
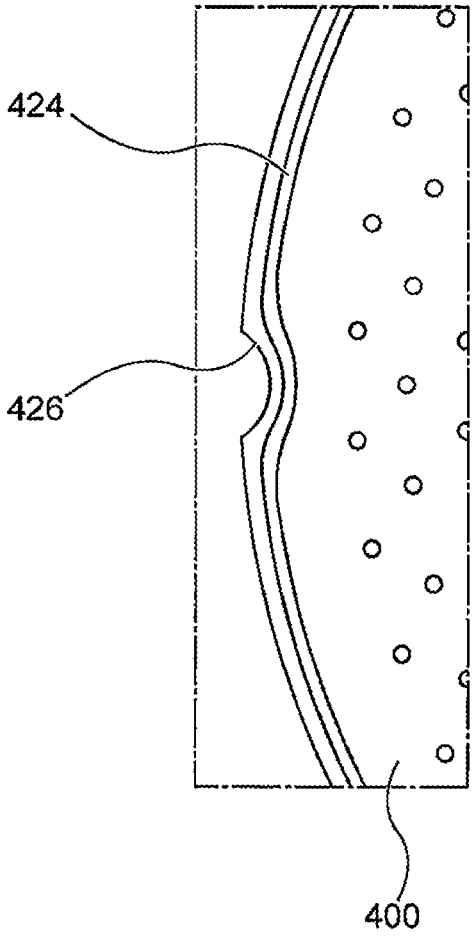
FIG. 3B is a plan view showing a region of the buffing table, in which a notch portion is formed, according to one embodiment.
Figure 4:
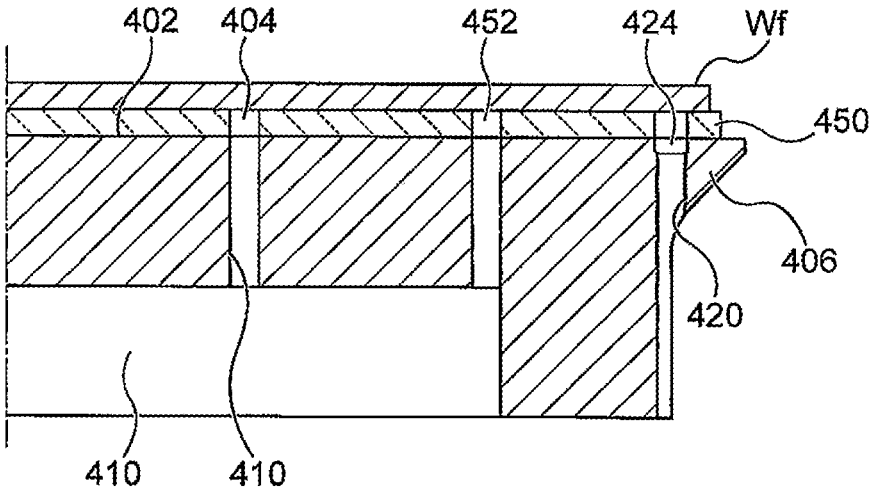
FIG. 4 is a cross-sectional view of the buffing table illustrated in FIG. 3A along the line E-E according to one embodiment.

FIG. 4 is a cross-sectional view of the buffing table 400 illustrated in FIG. 3A along the line E-E. As illustrated in FIG. 3A, the buffing table 400 includes an expanded edge portion 406. The expanded edge portion 406 extends in such a direction that the surface of the buffing table 400 expands outward. As illustrated in FIGS. 3A and 4, a second opening 424 (omitted in FIG. 2) is formed in the support face 402 of the buffing table 400 to be located in the expanded edge portion 406. In the expanded edge portion 406, there is formed a second fluid path 420 extending to the second opening 424. The second fluid path 420 comprises a plurality of holes. The second fluid path 420 is formed through the expanded edge portion 406 to open to the outside of the buffing table 400. As illustrated in FIG. 3A, the second openings 424 are formed as a plurality of continuously-arranged grooves disposed at least partially around a region where the first openings 404 are located. It can be said in short that the grooves are formed close to an outer periphery of the support face 402 of the buffing table 400. The holes forming the second fluid path 420 are arranged at regular intervals along the outer periphery of the support face 402 of the buffing table 400. The grooves are connected to the second fluid path 420 at regular intervals. Fluid (process liquid, for example) which has entered in the grooves passes through the second fluid path 420 to be discharged outside the buffing table 400. According to the embodiment illustrated in FIG. 3A, the second openings 424 are arranged around an area near the outer periphery of the support face 402 of the buffing table 400, except where four notch portions 426 are formed. According to another embodiment, the second opening 424 may be formed as a single ring-like groove which completely surrounds the area near the outer periphery of the support face 402. FIG. 3B is an enlarged view of a region of the buffing table 400, in which the notch portion 426 is formed, according to the another embodiment. The lift pins 480 (see FIG. 2) are arranged in the respective four positions where the notch portions 426 are formed according to the embodiments illustrated in FIGS. 3A and 3B. According to another embodiment, the second openings 424 may comprise a plurality of apertures arranged to at least partially surround the region where the first openings 404 are located. The second openings 424 formed into the plurality of apertures are connected directly to the second fluid path 420.

Figure 6:
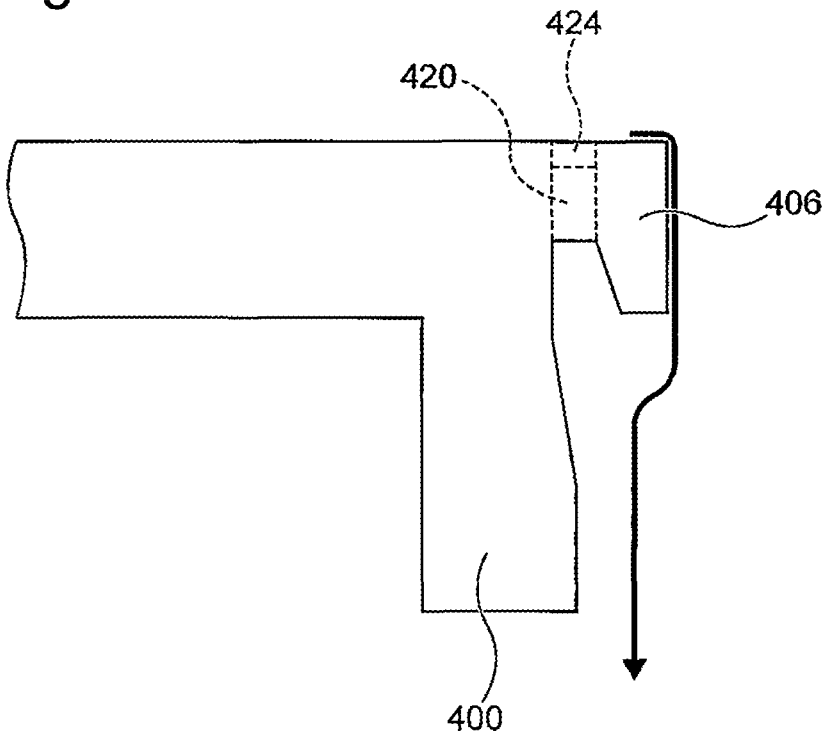
FIG. 6 is a cross-sectional view of the buffing table illustrated in FIG. 3A along the line E-E according to one embodiment.

FIG. 6 is a cross-sectional view of the buffing table 400 illustrated in FIG. 3A or 3B along the line E-E according to another embodiment. FIG. 6 omits the first fluid path 410 and the backing material 450. As illustrated in FIG. 6, the expanded edge portion 406 extends downward so that a tip end of the expanded edge portion 406 is located lower than where the second fluid path 420 is formed. The expanded edge portion 406 serves as a canopy and effectively prevents the process liquid outflowing toward the outer periphery of the wafer Wf as shown by arrow, from entering the gap between the support face 402 and a back surface of the wafer Wf.

In the buffing module 300A illustrated in FIG. 1, the wafer Wf subjected to buffing is placed on the support face 402 of the buffing table 400. The first fluid path 410 is vacuumized by the vacuum source 746. A back surface of the wafer Wf is thus vacuum-sucked to the first openings 404, so that the wafer Wf is held on the buffing table 400. During the buffing described above, slurry or another process liquid is fed onto the processed face of the wafer Wf. During the buffing, the first fluid path 410 continues to be vacuumized. As the result, negative pressure is generated in the gap between the back surface of the wafer Wf and the support face 402 or between the wafer Wf and the backing material 450. Therefore, without the second openings 424 and the second fluid path 420, slurry or another process liquid flows along the outer periphery of the wafer Wf and passes through the gap to reach the inner side of the support face 402. If the buffing table 400 according to the embodiments illustrated in FIGS. 1 to 4 is used to hold the wafer Wf by vacuum-suction, an air flow is created, which runs from the second fluid path 420 and passes through a gap between the wafer Wf and the support face 402 to reach the first fluid path 410. This releases (atmospherically releases) the negative pressure which exists near the second openings 424 and on the support face 402 on the outer side thereof. It is possible to suppress the slurry or another process liquid from flowing along the outer periphery of the wafer Wf, passing through the gap between the support face 402 and the back surface of the wafer Wf, and being sucked into the first openings 404 and the first fluid path 410. In other words, the second fluid path 420 functions as an atmospheric relief pathway which opens the second openings 424 to the atmosphere. An end portion of the second fluid path 420, which is located on the opposite side to the second openings 424, is open to the outside of the buffing table 400. The end portion of the second fluid path 420, which is located on the opposite side to the second openings 424, may be also called an atmospheric relief opening.

When the buffing is finished, the wafer Wf needs to be released from the buffing table 400. To release the vacuum-sucked wafer Wf, the vacuumization of the first fluid path 410 by the vacuum source 746 is discontinued. Deionized water is fed from the deionized water feeding source 714 to the first fluid path 410 only for a predetermined period of time. Thereafter, nitrogen is fed from the nitrogen source 744 to the first fluid path 410 only for a predetermined period of time. In the result, pressure in the first fluid path becomes higher than outside pressure, and the wafer Wf is released from the support face 402. If the slurry or process liquid used in the buffing has been sucked into the first fluid path 410, the slurry or process liquid in the first fluid path 410 is jetted out of the first fluid path 410 and the first openings 404 together with the deionized water and nitrogen used to release the wafer Wf. The slurry or process liquid passes through the gap between the support face 402 and the back surface of the wafer Wf to be jetted out from the outer periphery of the wafer Wf. The slurry or process liquid further runs around to the processed face side of the wafer Wf to stain the wafer Wf. The buffing table 400 according to the present embodiment suppresses or minimizes the suction of the slurry and process liquid into the first fluid path 410 during the buffing, and therefore reduces the possibility of staining the wafer Wf when releasing the wafer Wf. Even if a small amount of the slurry or process liquid is sucked into the first fluid path 410, when the deionized water and the nitrogen is fed to the first fluid path 410 to release the wafer Wf from the buffing table 400, a mixed fluid of the deionized water, nitrogen, and slurry or process liquid passes through the second openings 424 and the second fluid path 420 to be discharged outside the buffing table 400 before reaching the edge of the wafer Wf. The mixed fluid is thus prevented from running around to the processed face side of the wafer Wf. In other words, the second fluid path 420 functions as a fluid discharge pathway which discharges the fluid which has entered in the second openings 424. It can be also said that the second fluid path 420 located on the opposite side to the second openings leads to a fluid outlet. According to the present embodiment, the second fluid path 420 is formed through the buffing table 400 as illustrated in FIGS. 4 and 6. However, the form of the second fluid path 420 as the atmospheric relief pathway or the fluid outlet is not limited to the ones illustrated in FIGS. 4 and 6.

Figure 5:
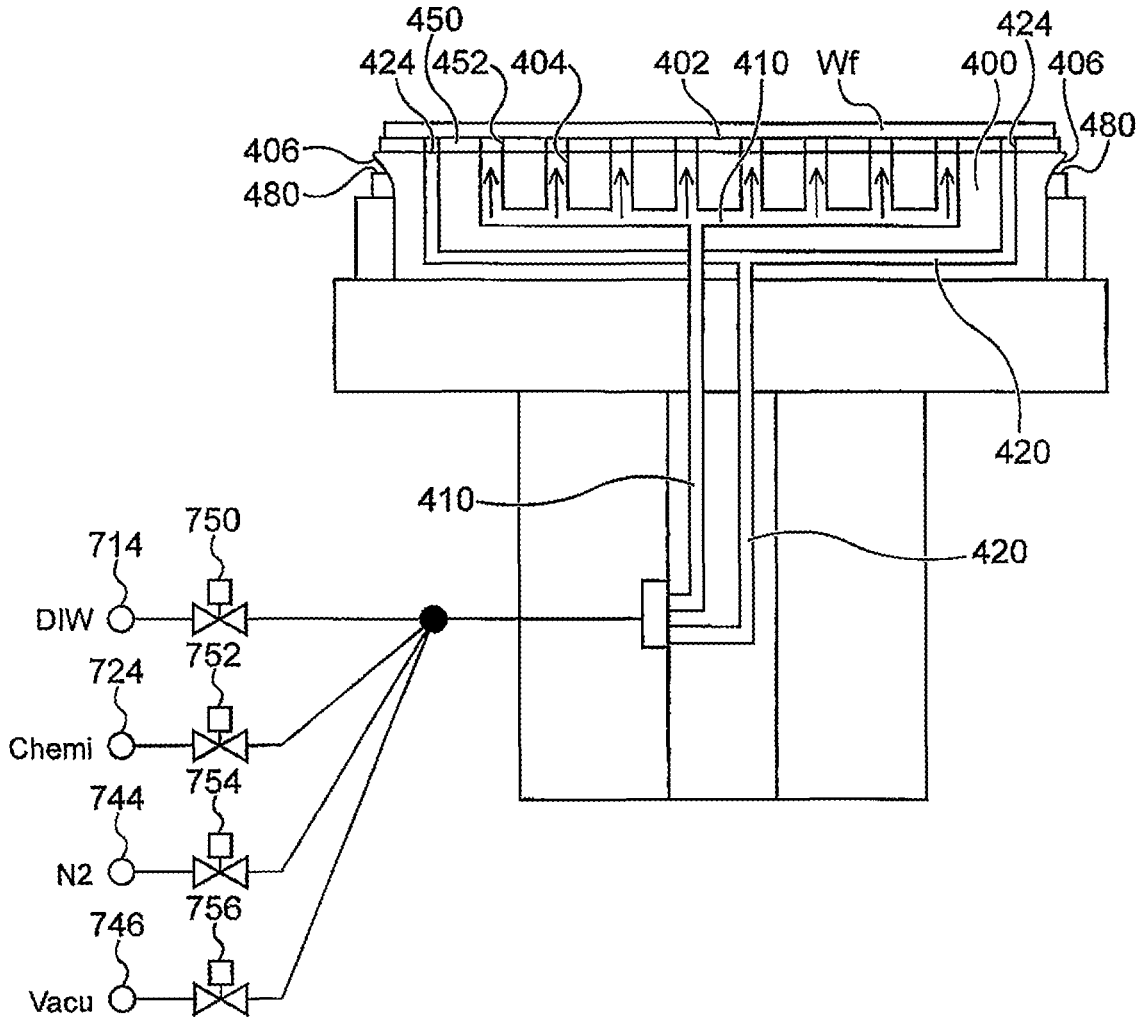
FIG. 5 schematically shows a cross-sectional view of a buffing table as one embodiment.

FIG. 5 schematically shows a cross-sectional surface of the buffing table 400 as one embodiment. As in FIG. 2, FIG. 5 shows the backing material 450 and the wafer Wf in a held position. The buffing table 400 illustrated in FIG. 5 includes the first openings 404, the first fluid path 410, the second opening 424, and the second fluid path 420 similarly to the embodiments illustrated in FIGS. 1 to 4. However, unlike the second fluid path 420 of the buffing table 400 according to the embodiments in FIGS. 1 to 4, the second fluid path 420 of the buffing table 400 according to the embodiment in FIG. 5 is not open to the outside of the buffing table 400. As illustrated in FIG. 5, according to the present embodiment, not only the first fluid path 410 but also the second fluid path 420 is connected to the deionized water feeding source 714, the chemical solution feeding source 724, the nitrogen source 744, and the vacuum source 746. The second fluid path 420 may be connected to an atmospheric relief valve (not shown). Unwanted liquid which has entered in the second fluid path 420 is discharged by a gas-liquid separator (not shown) disposed upstream from the vacuum source 746. This makes it possible to feed various kinds of fluids to the second fluid path 420 and vacuumize the second fluid path. For the sake of convenience, FIG. 5 illustrates the first and second fluid paths 410 and 420 being connected to the deionized water feeding source 714, the chemical solution feeding source 724, the nitrogen source 744, and the vacuum source 746 through the same pathway. However, the first fluid path 410 and the second fluid path 420 may be connected to the deionized water feeding source 714, the chemical solution feeding source 724, the nitrogen source 744, and the vacuum source 746 through different pathways. Fluids which flow through the first fluid path 410 and the second fluid path 420 may be therefore individually switchable. The foregoing structure reduces the possibility of staining the wafer Wf with the slurry or another process liquid at the release of the wafer Wf.

For example, when the wafer Wf is vacuum-sucked to the support face 402 of the buffing table 400 for buffing the wafer Wf, the second fluid path 420 is vacuumized to vacuum-suck the wafer Wf to the support face 402 of the buffing table 400, whereas the first fluid path 410 is not vacuumized. During the buffing, therefore, the slurry or another process liquid is sometimes sucked into the second fluid path 420 but is not sucked into the first fluid path 410. When the buffing is finished, and the wafer Wf needs to be released from the support face 402 of the buffing table 400, the first fluid path 410 is fed with deionized water and/or nitrogen gas to release the wafer Wf, whereas the second fluid path 420 is not fed with deionized water or nitrogen gas. Therefore, the slurry or another process liquid which has been sucked into the second fluid path 420 during the buffing is not jetted onto the wafer at the release of the wafer Wf. This reduces the possibility of staining the wafer Wf. To wash out the slurry and another process liquid which has entered in the second fluid path 420, the second fluid path 420 and the support face 402 of the buffing table 400 may be cleansed by feeding various kinds of fluids, such as deionized water and chemical solution, into the second fluid path 420, for example, at the time of replacing the wafer Wf.

When the wafer Wf is vacuum-sucked to the support face 402 of the buffing table 400 for buffing the wafer Wf, the first fluid path 410 is vacuumized to vacuum-suck the wafer Wf to the support face 402 of the buffing table 400. The second fluid path 420, however, is not vacuumized. During the buffing, therefore, the slurry or another process liquid is sometimes sucked into the first fluid path 410 but is not sucked into the second fluid path 420. When the buffing is finished, and the wafer Wf needs to be released from the support face 402 of the buffing table 400, the second fluid path 420 is fed with deionized water and/or nitrogen gas to release the wafer Wf, whereas the first fluid path 410 is not fed with deionized water or nitrogen gas. For this reason, the slurry or another process liquid which has been sucked into the first fluid path 410 during the buffing is not jetted onto the wafer at the release of the wafer Wf. This reduces the possibility of staining the wafer Wf. To wash out the slurry and another process liquid which has entered in the first fluid path 410, the first fluid path 410 and the support face 402 of the buffing table 400 may be cleansed by feeding various kinds of fluids, such as deionized water and chemical solution, to the first fluid path 410.

According to one embodiment, if the wafer Wf is vacuum-sucked to the support face 402 of the buffing table 400 for buffing the wafer Wf, the wafer Wf is vacuum-sucked to the support face 402 of the buffing table 400 by vacuumizing both the first and second fluid paths 410 and 420. The slurry or another process liquid is sometimes sucked during the buffing into the second fluid path 420 arranged outside. However, very little slurry or another process liquid is sucked into the first fluid path 410 located inside. When the buffing is finished, and the wafer Wf needs to be released from the support face 402 of the buffing table 400, the wafer Wf can be released by feeding deionized water and/or nitrogen gas to the first fluid path 410. At this time, the second fluid path 420 is not fed with deionized water or nitrogen gas. For this reason, the slurry or another process liquid which has been sucked into the second fluid path 420 during the buffing is not jetted onto the wafer Wf at the release of the wafer Wf. This reduces the possibility of staining the wafer Wf. To wash out the slurry or another process liquid which has entered in the second fluid path 420, the second fluid path 420 and the support face 402 of the buffing table 400 may be cleansed by feeding the second fluid path 420 with various kinds of fluids, such as deionized water and chemical solution, at the time of replacing the wafer Wf.

According to the embodiment illustrated in FIG. 5, the first openings 404, the first fluid path 410, the second opening 424, and the second fluid path 420 may be disposed in an arbitrary manner. For example, in the buffing table 400 of the embodiment illustrated in FIG. 5, the second opening 424 and the second fluid path 420 may be formed in either the expanded edge portion 406 or any other positions.

The table for holding a workpiece and the processing apparatus having the table according to the present invention has been described, taking the buffing apparatus as an example. The invention, however, is not limited to the above-described buffing apparatus. On the contrary, the table disclosed here and the processing apparatus having the table are applicable to other apparatuses configured to hold a workpiece by vacuum-suction. The table disclosed here is applicable particularly to wet substrate processing apparatuses configured to process a substrate while feeding liquid to the substrate.

REFERENCE SIGNS LIST

400 table
402 support face
404 first opening
406 expanded edge portion
410 first fluid path
420 second fluid path
424 second opening
450 backing material
452 throughhole
502 polishing pad
714 deionized water feeding source
724 chemical solution source
744 nitrogen source
746 vacuum source
Wf wafer

What is claimed is:

1. A wet substrate processing apparatus for processing a substrate, comprising:

a table for holding a substrate; and a nozzle for feeding process liquid to the substrate held on the table, wherein the table includes an upwardly facing support face for supporting the substrate when the substrate is placed on the upwardly facing support face;

a first opening formed in the support face;

a second opening formed in the support face and arranged at least partially around the first opening;

a first fluid path configured to extend to the first opening of the support face through the table and be connectable to a vacuum source; and a second fluid path configured to extend to the second opening of the support face through the table and open the second opening to the atmosphere, wherein the second opening is formed as at least one groove configuring a ring-shape as a whole along an outer periphery of the support face of the table.

2. The wet substrate processing apparatus according to claim 1, wherein the second fluid path extends through at least part of the table.

3. The wet substrate processing apparatus according to claim 2, wherein the table includes an expanded edge portion which extends in such a direction that a surface of the table expands; the second opening is located in the expanded edge portion; and the second fluid path extends through the expanded edge portion.

4. The wet substrate processing apparatus according to claim 1, wherein the first fluid path is configured to be connectable to a fluid feeding source for feeding fluid from the first opening through the first fluid path.

5. The wet substrate processing apparatus according to claim 4, wherein the fluid includes at least one from a group consisting of air, nitrogen, and water.

6. The wet substrate processing apparatus according to claim 1, wherein the table is configured to be rotatable.

7. The wet substrate processing apparatus according to claim 1, including a polishing pad for polishing the substrate.

8. The wet substrate processing apparatus according to claim 1, wherein the support face is an upward facing top surface of the table.

9. A wet substrate processing apparatus for processing a substrate, comprising:

a table for holding a substrate; and a nozzle for feeding process liquid to the substrate held on the table, wherein the table includes an upwardly facing support face for supporting the substrate when the substrate is placed on the upwardly facing support face;

a first opening formed in the support face;

a second opening formed in the support face and arranged at least partially around the first opening;

a first fluid path configured to extend to the first opening of the support face through the table and be connectable to a vacuum source; and a second fluid path configured to extend to the second opening of the support face through the table and be connectable to a fluid feeding source, wherein the second opening is formed as at least one groove configuring a ring-shape as a whole along an outer periphery of the support face of the table.

10. The wet substrate processing apparatus according to claim 9, wherein the fluid includes at least one from a group consisting of air, nitrogen, and water.

11. The wet substrate processing apparatus according to claim 9, wherein the table is configured to be rotatable.

12. The wet substrate processing apparatus according to claim 9, including a polishing pad for polishing the substrate.

13. The wet substrate processing apparatus according to claim 9, wherein the support face is an upward facing top surface of the table.

14. The wet substrate processing apparatus according to claim 9, wherein the second fluid path is selectively connectable to each of the vacuum source, a deionized water feeding source, a chemical solution heeding source, and a nitrogen source.

15. A wet substrate processing apparatus for processing a substrate, comprising:

a table for holding a substrate; and a nozzle for feeding process liquid to the substrate held on the table, wherein the table includes an upwardly facing support face for supporting the substrate when the substrate is placed on the upwardly facing support face;

a first opening formed in the support face;

a second opening formed in the support face and arranged at least partially around the first opening;

a first fluid path configured to extend to the first opening of the support face through the table and be connectable to a fluid feeding source; and a second fluid path configured to extend to the second opening of the support face through the table and be connectable to a vacuum source, wherein the second opening is formed as at least one groove configuring a ring-shape as a whole along an outer periphery of the support face of the table.

16. The wet substrate processing apparatus according to claim 15, wherein the fluid includes at least one from a group consisting of air, nitrogen, and water.

17. The wet substrate processing apparatus according to claim 15, wherein the first fluid path is configured to be connectable to the vacuum source.

18. The wet substrate processing apparatus according to claim 15, wherein the table is configured to be rotatable.

19. The wet substrate processing apparatus according to claim 15, including a polishing pad for polishing the substrate.

20. The wet substrate processing apparatus according to claim 15, wherein the support face is an upward facing top surface of the table.

21. The wet substrate processing apparatus according to claim 15, wherein the first fluid path is selectively connectable to each of the vacuum source, a deionized water feeding source, a chemical solution heeding source, and a nitrogen source.

* * * * *